US007008278B2

(12) United States Patent
Miura

(10) Patent No.: US 7,008,278 B2
(45) Date of Patent: Mar. 7, 2006

(54) LEVER-SUPPORT BRACKET STRUCTURE FOR A SMALL WATERBOAT

(75) Inventor: Takayoshi Miura, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 212 days.

(21) Appl. No.: 10/660,106

(22) Filed: Sep. 11, 2003

(65) Prior Publication Data

US 2004/0082233 A1 Apr. 29, 2004

(30) Foreign Application Priority Data

Sep. 11, 2002 (JP) ..... 2002-264989

(51) Int. Cl.
*B60K 41/00* (2006.01)

(52) U.S. Cl. ..... 440/84

(58) Field of Classification Search ..... 440/38, 440/84

See application file for complete search history.

(56) References Cited

U.S. PATENT DOCUMENTS 3,479,917 A * 11/1969 Zitnik, Jr. et al. ..... 84/312 R
RE28,187 E * 10/1974 Longenecker ..... 280/507

FOREIGN PATENT DOCUMENTS

JP 09281132 A 10/1997

* cited by examiner

*Primary Examiner*—Stephen Avila
(74) *Attorney, Agent, or Firm*—Carrier, Blackman & Associates, P.C.; Joseph P. Carrier; William D. Blackman

(57) ABSTRACT

A lever-support bracket apparatus for a small waterboat allows a lever-support bracket and a socket section to be increased in strength and rigidity, by combining these functions in a single unitary apparatus. Using the described apparatus, a lever-support bracket and a socket section can be laid out rather easily, and the number of members can be reduced. With a lever support bracket apparatus 30, a reverse operation lever 34 is allowed to operate a reverse bucket 21, and the reverse operation lever 34 is arranged proximate the front end of a seat 23 and is attached, to swing freely, to a hull 11 using the lever-support bracket 31. Further, to the lever-support bracket 31, a socket section 55 is formed, to be a piece therewith, into which a tongue-shaped piece 51 at a front end 50 of the seat 23 can be inserted.

15 Claims, 5 Drawing Sheets

LEVER-SUPPORT BRACKET STRUCTURE FOR A SMALL WATERBOAT

BACKGROUND OF THE INVENTION

1. Field of the Invention

The present invention relates to a lever-support bracket apparatus for a small waterboat, in which the apparatus is a unitary member capable of supporting both the front end of a seat, and an operation lever for a reverse bucket.

2. Description of the Background Art

A small waterboat, or personal watercraft, is a small size craft that is constructed and arranged to glide under power across the surface of a sea or of a lake. Many jet skis and other different types of personal watercraft are known and are commercially available. One example of a small waterboat is described in Japanese Laid-Open Patent No. Hei 9-281132.

The small waterboat described in this reference includes an engine and a jet propeller driven by the engine, both provided in a craft body, and also includes a steering nozzle behind the jet propeller. In the operation of the small waterboat according to the reference, the jet propeller is driven by the engine to rotate an impeller of the water jet propeller, so that water is taken in through an inlet port of the craft bottom by the rotation of the impeller.

The water taken in is expelled rearwardly, as exhaust jet water from the rear end of the steering nozzle, so that the small waterboat can be moved forward by the jetting force of the jet water.

The small waterboat is also provided with a reverse bucket, to enable a user to bring the hull backward when necessary. By moving the reverse bucket towards the rear of the steering nozzle, the jet water which has been ejected from the steering nozzle can be deflected towards the front of the craft, successfully causing the hull to move backward.

An operation lever is coupled to the reverse bucket via a reverse operation cable, and the operation lever is pivotally attached to a lever-support bracket, at the front end of a seat.

Such attachment of the operation lever at the front end of the seat allows an operator to operate the lever while seated in an ordinary posture.

Further, since the seat is provided behind the operation lever, a tongue-shaped piece is provided at the front end thereof, and a locking structure is provided at the rear end thereof. The seat can be attached to the hull by inserting the tongue-shaped piece into a socket section on the hull, and by latching the locking structure to the hull.

As noted, the operation lever is provided for operating the reverse bucket, and in practice, the lever-support bracket, supporting such an operation lever, receives a rather large operation force applied thereto. Thus, the lever-support bracket has to be made strong, durable and relatively rigid.

Moreover, to firmly fasten the seat to the hull, the socket section, into which the tongue-shaped piece located at the seat front end is inserted, also has to be made strong, durable and relatively rigid.

The problem here is that, to increase the strength and rigidity of the lever-support bracket and the socket section, these members will be increased in size. What is worse, the lever-support bracket and the socket section need to be placed close to each other. This makes it difficult to secure space sufficient to accommodate both the lever-support bracket and the socket section.

If a space large enough to accommodate both the lever-support bracket and the socket section is to be secured, this poses limitations on component layout in the hull, placing significant limits on design flexibility.

Further, the conventional lever-support bracket and socket section each require two separate component pieces, for a total of four pieces. Such an increase of the number of parts will stand in the way of cost reduction.

SUMMARY OF THE INVENTION

An illustrative lever-support bracket apparatus according to a first embodiment of the invention is useable with a small waterboat having a deck, in which a seat is placed above the deck, an engine is placed below the deck, and a jet propulsion unit is placed behind the engine. A steering nozzle, for fixing an ejection direction of jet water, is placed behind the jet propulsion unit, and a reverse bucket for guiding the jet water to the front is placed adjacent the back of the steering nozzle. The reverse bucket is made operable by an operation lever, situated at a front end of the seat, and is the operation lever is pivotally attached to the deck by a lever-support bracket, to swing freely.

A socket section, into which a tongue-shaped piece at the front end of the seat can be inserted, is integrally formed as part of the lever-support bracket apparatus hereof, and forms a unitary integral piece with the lever-support bracket. The socket section is formed together with the lever-support bracket, to which an operation lever is attached. Accordingly, this allows attachment of the operation lever to the lever-support bracket, and also provides a receptacle in the same apparatus for receiving a tongue-shaped piece at the front end of a seat.

As such, the lever-support bracket can be increased in rigidity by integrating, as a single member, the member for attaching the operation lever and the socket section for receiving the tongue-shaped piece into the lever-support bracket.

Also, by integrating, as a single member, the member for attaching the operation lever and the socket section for receiving the tongue-shaped piece into the lever-support bracket, the members can be compact in size. Thanks thereto, the lever-support bracket can be laid out rather easily.

Additionally, by integrating, as a single member, the member for attaching the operation lever and the socket section for receiving the tongue-shaped piece into the lever-support bracket, the number of the members can be reduced.

Therefore, an object of the invention is to provide a lever-support bracket apparatus for a small waterboat in which the lever-support bracket and a socket section can be increased in rigidity.

It is another object of the invention to provide a lever-support bracket apparatus for a small waterboat in which the lever-support bracket and the socket section can be laid out rather easily.

It is yet another object of the present invention to provide a lever-support bracket apparatus for a small waterboat in which the number of parts can be decreased.

For a more complete understanding of the present invention, the reader is referred to the following detailed description section, which should be read in conjunction with the accompanying drawings. Throughout the following description and in the drawings, like numbers refer to like parts.

DETAILED DESCRIPTION

An illustrative embodiment of a lever-support bracket apparatus according to the invention is described below, with reference to the accompanying drawings. Herein, expressions of "front", "rear", "left", and "right" denote the directions viewed from the vantage point of a driver. Here, the drawings are referred to with the same orientation as indicated by the reference signs.

Figure 1:
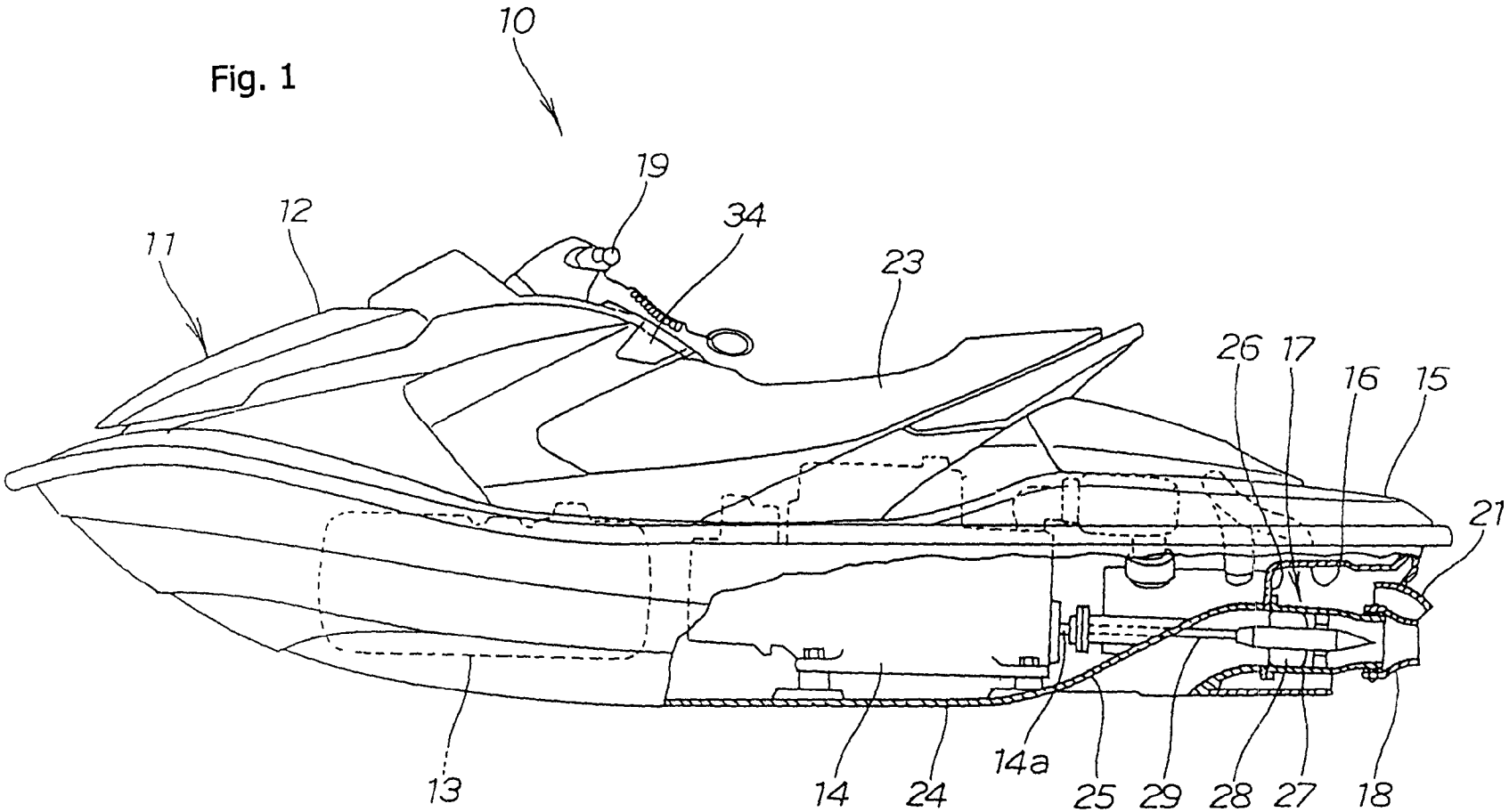
FIG. 1 is a side plan view of a small waterboat with a lever-support bracket apparatus according to an illustrative embodiment of the invention.

FIG. 1 is a side plan view of a small waterboat, including a lever-support bracket apparatus according to an illustrative embodiment of the invention. The structure of the depicted embodiment is intended to illustrate, rather than to limit the invention.

In a small waterboat 10, a fuel tank 13 is provided in a front section 12 of a hull 11, and an engine 14 is provided behind the fuel tank 13. Behind the engine 14, there is a hull tail 15 provided with a jet propulsion chamber 16. This jet propulsion chamber 16 includes a water jet propulsion unit (jet propulsion unit) 17. A steering nozzle 18 is provided for expelling water from the water jet propulsion unit 17, and a steering handle 19 is also provided above the fuel tank 13, for permitting a user to horizontally swing the steering nozzle 18. Behind the steering nozzle 18, a reverse bucket 21 is provided. A reverse operation lever (operation lever) 34 is provided towards the rear of the steering handle 19, to permit a user to vertically swing the reverse bucket 21. A seat 23 is also provided behind the reverse operation lever 34, as shown.

In the water jet propulsion unit 17, an intake opening 25 is formed at a hull bottom 24 of the hull 11. This intake opening 25 extends to the water jet propulsion chamber 16, in which a wall section 26 is provided with a cylindrical stator 27. In the stator 27, an impeller 28 is placed in a rotatable manner, and a shaft 29 of the impeller 28 is coupled with a driving shaft 14*a*.

In the small waterboat 10, by rotating the driving shaft 14*a* by the engine 14, the impeller 28 can be accordingly rotated. Through rotation of the impeller 28, the intake opening 25 ingests water for guiding into the stator 27.

This ingested water is then ejected rearwardly from the stator 27 as a water jet, so that the small waterboat 10 can move forward.

Figure 2:
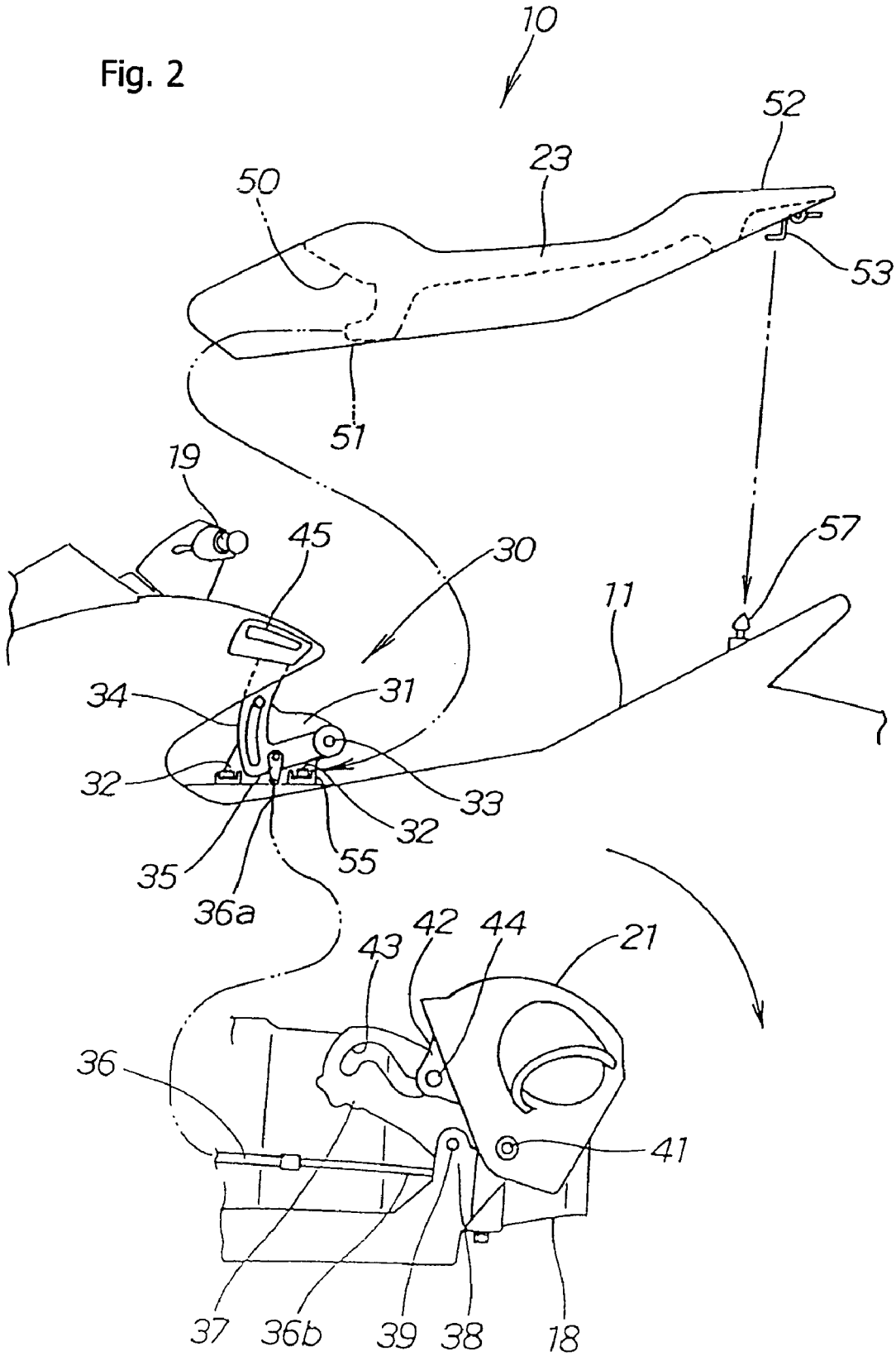
FIG. 2 is an exploded detail view of the lever-support bracket apparatus of FIG. 1.

FIG. 2 is an exploded detail view of the lever-support bracket apparatus of FIG. 1.

In the vicinity of the steering handle 19, a lever-support bracket 31, as a part of the lever-support bracket apparatus 30, is attached to the hull 11 by bolts 32. A reverse operation lever 34 is pivotally attached to this lever-support bracket 31, to swing freely, using an attachment bolt 33.

A front end 36*a* of an operation cable 36 is coupled to the reverse operation lever 34 via a joint 35, and a rear end 36*b* thereof is coupled to a swing lever 37.

The swing lever 37 is pivotally and swingably attached to a support plate 38, using a spindle 39.

A reverse bucket 21 is also pivotally and swingably attached to the support plate 38 using another spindle 41. A protrusion 42, at the front end of the reverse bucket 21, has a slide bolt attached thereto. The protrusion is coupled to a sliding recess 43 formed in the swing lever 37, by placing the slide bolt 44 therethrough.

The operator grasps a handle 45 of the reverse operation lever 34, and pulls the lever up therewith. This causes the operation cable 36 to pivotally move the swing lever 37, centered on the spindle 39, in the direction indicated by the arrow.

Swinging movement of the swing lever 37, in turn, makes the reverse bucket 21, centered on the spindle 41, also swing in the direction indicated by the arrow. This allows the reverse bucket 21 to be moved rearwardly and placed behind the steering nozzle 18.

When the reverse bucket 21 is moved behind the steering nozzle 18, the jet water ejected from the steering nozzle 18 is redirected towards the front. This reversal of the direction of water flow causes the small waterboat 10 to go backward.

A tongue-shaped piece 51 is provided at the bottom portion of a front end 50 of the seat 23, as shown, and a lock section 53 is also provided at a rear end 52 of the seat. The seat 23 can be attached to the hull 11 by inserting the tongue-shaped piece 51 into a socket section 55 in the lever-support bracket apparatus 30, as indicated by the arrow in FIG. 3, and by latching the lock section 53 to a vertical post 57 attached to the hull 11.

Here, the socket section 55 is connected to the lever-support bracket 31 in a single unified structure.

Figure 3:
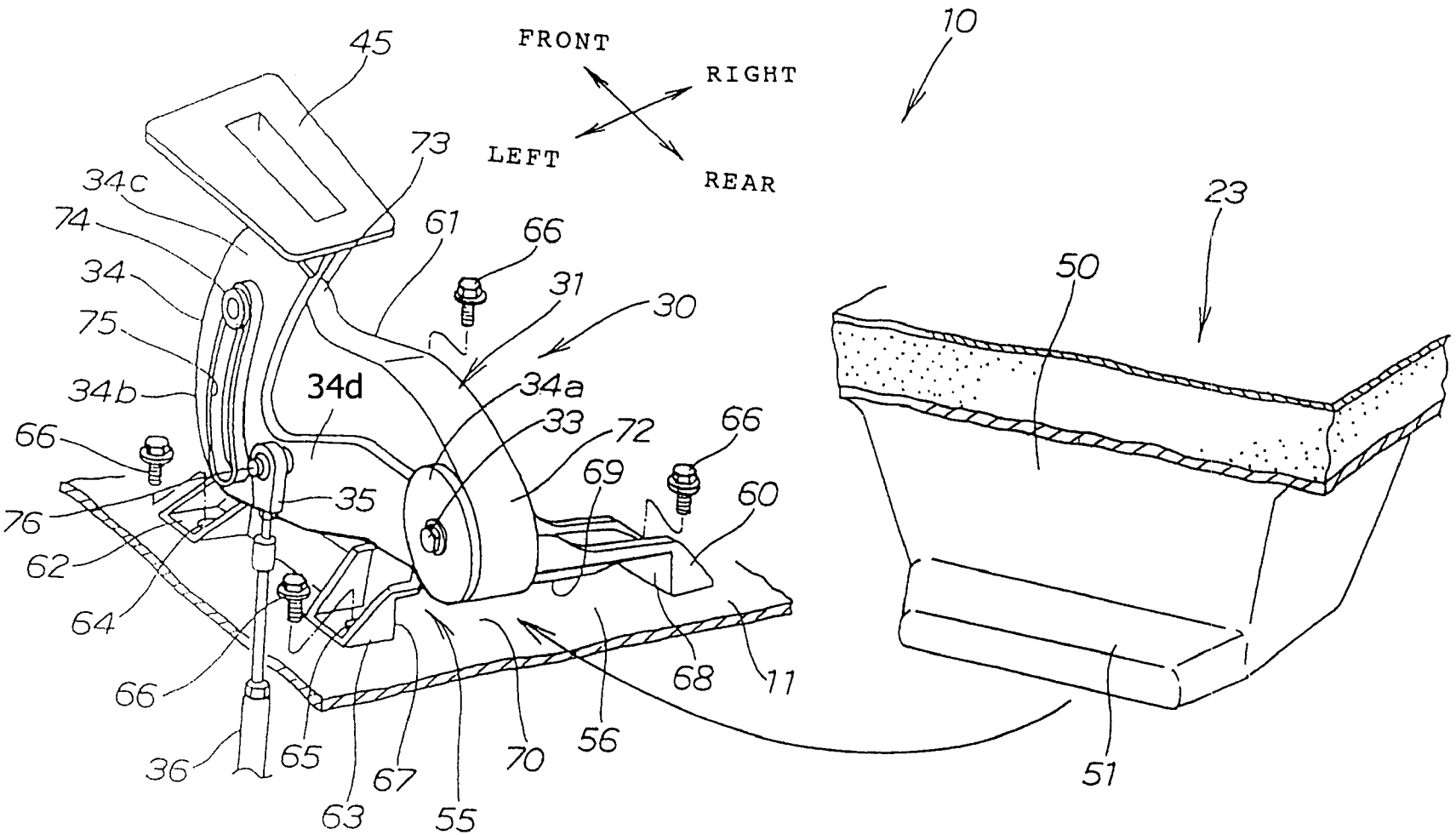
FIG. 3 is a perspective view of the lever-support bracket apparatus of FIGS. 1–2.

FIG. 3 is a is a perspective view of the lever-support bracket apparatus of FIGS. 1-2.

In the depicted lever-support bracket apparatus 30, the reverse operation lever 34 is placed at the front end of the seat 23 (refer to FIG. 1), and the reverse operation lever 34 is pivotally attached to the hull 11 (deck) via the lever-support bracket 31. Also, the socket section 55, into which the tongue-shaped piece 51 at the front end 50 of the seat 21 can be inserted, is connected to the lever-support bracket 31 in a single unified structure.

The lever-support bracket 31 includes a base section 60, and a vertical support section 61 extending upwardly from the base section 60. These are formed to be a single unitary member, which may be made, for example, from resin or from a high-strength plastic material.

The base section 60 is provided, at front and rear ends, with front and rear leg sections 62 and 63, respectively. At right and left ends of the front leg section 62, front attachment holes 64 and 64 (the attachment hole on the right side is not shown) are formed, respectively. Similarly, at right and left ends of the rear leg section 63, rear attachment holes 65 and 65 are formed.

Bolts 66 are inserted into the front attachment holes 64 and 64 and the rear attachment holes 65 and 65 on both sides, as shown. The inserted bolts 66 are then screwed into the hull 11. In this manner, the lever-support bracket 31 can be attached to the hull 11.

As such, by attaching the base section 60 to the hull 11 using the bolts 66, the base section 60 and the hull 11 can cooperate to form the socket section 55.

To be specific, in the socket section 55, right and left internal planes of the rear leg section 63 of the base section 60 form left and right internal walls 67 and 68, the upper plane of the rear leg section 63 forms a ceiling plane 69, and a section of the hull 11, opposed to and facing the ceiling plane 69, forms a floor plane 70. Thereby, the internal planes 67 and 68, the ceiling plane 69, and the floor plane 70 cooperate to define the socket section 55, which forms a receiving section for accepting the tongue-shaped piece 51, and an opening 56 into which the tongue-shaped piece 51 may be inserted.

Accordingly, it will be seen that the tongue-shaped piece 51 at the front end 50 of the seat 23 can be inserted through the opening 56 and into the socket section 55, as indicated by the arrow in FIG. 3.

The vertical support section 61 extends, in the fore-and-aft direction, from the front leg section 62 to the rear leg section 63 of the base section 60. A rear end 34*a* of the reverse operation lever 34 is rotatably attached to a rear end 72 of the vertical support section 61, using the attachment bolt 33. A sliding rod 74, attached to a front end 73 of the vertical support section 61, is inserted into a sliding recess 75 of the reverse operation lever 34, to permit the lever to freely slide thereon.

The reverse operation lever 34 is substantially L-shaped, and includes a disk section 34*a* at the rear end thereof, which is pivotally attached to the rear end 72 of the vertical support section 61 using the attachment bolt 33. The arcuate sliding recess 75 is formed in a front section 34*b* of the reverse operation lever 34, and the slide rod 74 is arranged in this sliding recess 75 to slide freely therein. The reverse operation lever 34 also includes an upper end 34*c* provided with the handle 45.

Further, in the reverse operation lever 34, a center section 34*d* thereof is attached to the operation cable 36 at the joint 35 using a bolt 76.

The reverse operation lever 34, centered on the attachment bolt 33, is swung upwardly by grasping the handle 45 and pulling upwardly thereon. At this time, the sliding recess 75 moves along the sliding rod 74.

As such, by swinging upward the reverse operation lever 34 centered on the attachment bolt 33, the bolt 76 and the joint 35 move upward together, so that the operation cable 36 can be pulled up.

With the lever-support bracket apparatus 30 of the present invention, the socket section 55 is formed together with the lever-support bracket 31 as part of an integrated unit, to which the reverse operation lever 34 is attached. This allows the reverse operation lever 34 to be attached to the lever-support bracket 31, and the tongue-shaped piece 51 at the front end 50 of the seat 23 to be received in the socket section 55 of the same unitary apparatus.

The lever-support bracket 31 can be increased in rigidity by integrating the bracket for attaching the reverse operation lever 34 and the socket section for receiving the tongue-shaped piece 51 into a single unitary apparatus.

Also, by integrating, as a single member, the member for attaching the reverse operation lever 34 and the socket section 55 for receiving the tongue-shaped piece 51 into the lever-support bracket 31, the combined apparatus 30 can be compact in size, especially compared to the conventional 4-piece design. As a result, the lever-support bracket 31 can be laid out rather easily, successfully increasing the design flexibility.

Moreover, by integrating, as a single member, the member for attaching the reverse operation lever 34 and the socket section for receiving the tongue-shaped piece 51 into the lever-support bracket 31, the number of the members can be reduced, successfully leading to cost reduction.

Figure 4:
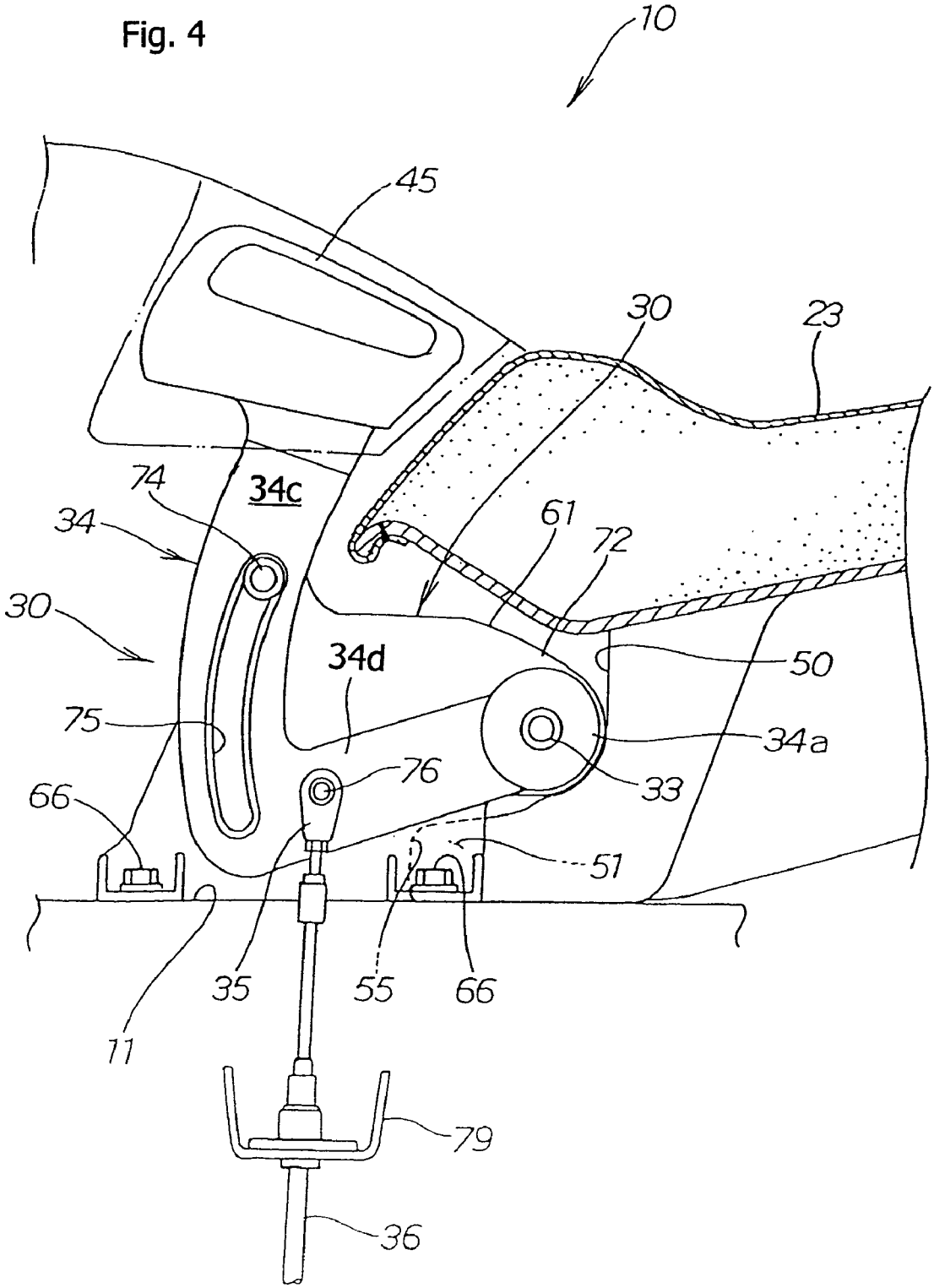
FIG. 4 is a side view showing the lever-support bracket apparatus of FIGS. 1–3.

FIG. 4 is a side view showing a lever-support bracket apparatus for a small waterboat according to the invention.

The lever-support bracket 31 of the lever-support bracket apparatus 30 is attached to the hull 11 using bolts 66, and a rear end 34*a* of the reverse operation lever 34 is pivotally attached to a rear end 72 of the vertical support section 61, using the attachment bolt 33. Then, the sliding rod 74 is inserted into the sliding recess 75 of the reverse operation lever 34 to permit the lever 34 to freely slide thereon. The center section 34*c* of the reverse operation lever 34 is attached to the operation cable 36 at the joint 35, using the bolt 76. The operation cable 36 is coupled to this joint 35, and the tongue-shaped piece 51 at the front end 50 of the seat 23 is inserted into the socket section 55.

With such a structure, the lever-support bracket 31 can be attached with the reverse operation lever 34 to swing freely, and the tongue-shaped piece 51 at the front end 50 of the seat 23 can be inserted into the socket section 55 of the lever-support bracket 31.

Herein, 79 denotes a fixed bracket, and with the fixed bracket 79, the operation cable 36 can be held in place.

Figure 5:
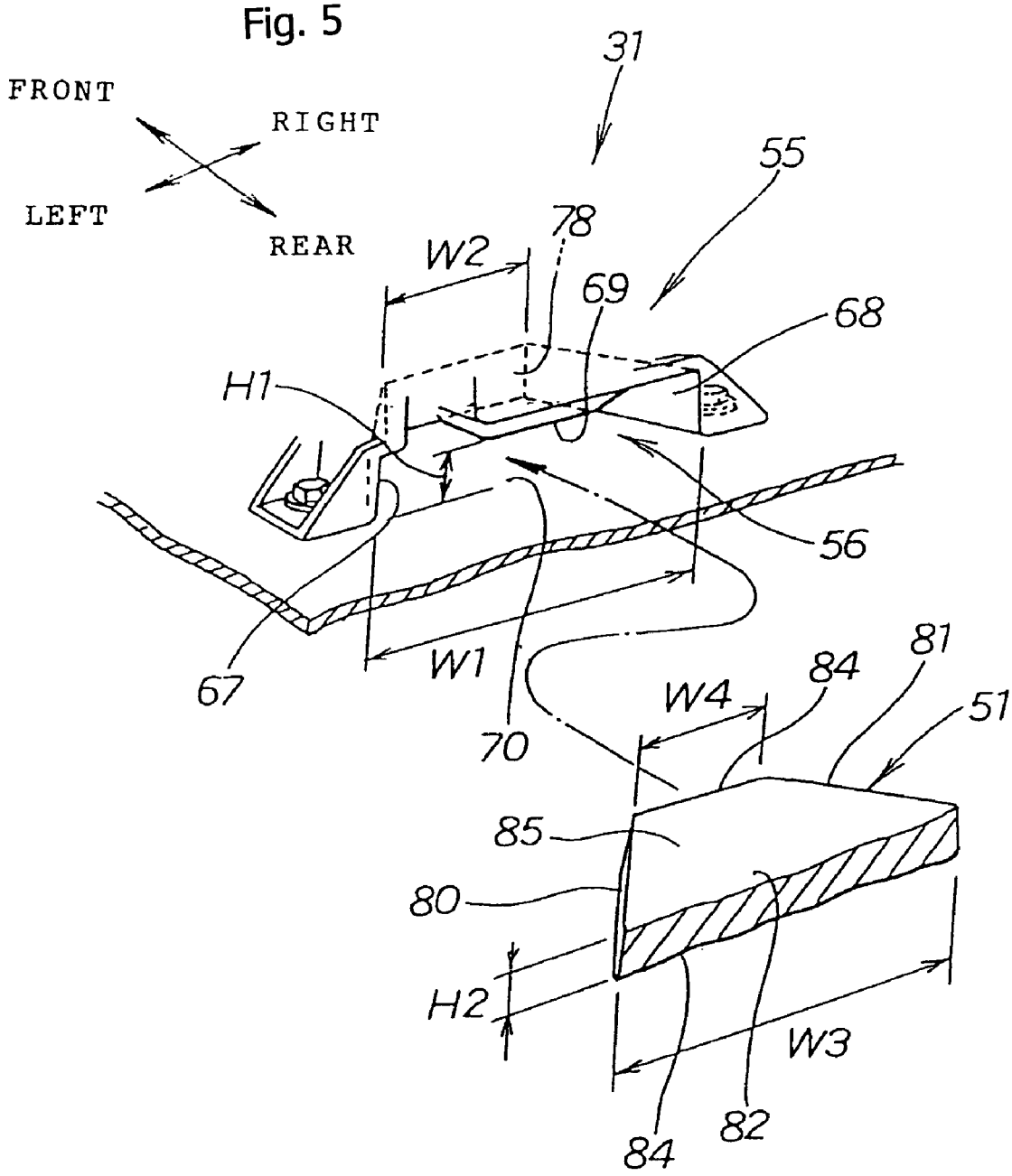
FIG. 5. is a side view showing the relationship between a socket section and a tongue shaped piece in the depicted lever-support bracket apparatus.

FIG. 5 is a side view showing the relationship between the socket section and the tongue-shaped piece in the lever-support bracket apparatus of the invention.

The socket section 55 of the lever-support bracket 31 is so formed as to taper in width from the opening 56 to a front end section 78. Specifically, the width is gradually narrowed down between a left internal wall 67 and a right internal wall 68, from W1 at the opening 56 to W2 at the front end section 78. And the height from a floor plane 70 to a ceiling plane 69 is H1.

The tongue-shaped piece 51 at the front end 50 of the seat 23 (see FIG. 3) is a member formed to be substantially trapezoidal, and to taper in width from a base end section 82 to a tip section 83. Specifically, the width is gradually narrowed down between a left side wall 80 and a right side wall 81, from W3 at the base end section 82 to W4 at the tip section 83. And the height from a bottom plane 84 to a top plane 85 is H2.

The width W1 of the opening 56 is so formed as to be slightly larger than the width W3 of the base end section 82, and the width W2 of the front end section 78 slightly larger than the width W4 of the tip section 83. Similarly, the height H1 from the floor plane 70 to the ceiling plane 69 is so formed as to be slightly larger than the height H2 from the bottom plane 84 to the top plane 85.

With such a structure, the socket section 55 can securely hold the tongue-shaped piece 51 at the time of insertion of the tongue-shaped piece 51 into the socket section 55. Thus, as shown in FIG. 1, the seat 23 can be attached to the hull 11 in a suitable manner.

Note herein that, described in the above embodiment is a case where the lever-support bracket 31 is made by resin in a piece. This is surely not restrictive, and any other material will do.

Moreover, the shape of the lever-support bracket 31 is no more than an example, and the exemplarily shown shape is not the only choice.

The invention achieves the following effects with the above structure.

According to claim 1, a socket section is formed to be a piece with a lever-support bracket to which an operation lever is attached. Accordingly, this allows attachment of the operation lever to the lever-support bracket, and insertion thereinto of a tongue-shaped piece at the front end of a seat.

As such, the lever-support bracket can be increased in rigidity by integrating, as a single member, the member for attaching the operation lever and the socket section for receiving the tongue-shaped piece into the lever-support bracket.

Accordingly, the lever-support bracket can securely support the operation lever and the front section of the seat.

Also, by integrating, as a single member, the member for attaching the operation lever and the socket section for receiving the tongue-shaped piece into the lever-support bracket, the members can be compact in size. Thanks thereto, the lever-support bracket can be laid out rather easily, successfully increasing the design flexibility.

Moreover, by integrating, as a single member, the member for attaching the operation lever and the socket section for receiving the tongue-shaped piece into the lever-support bracket, the number of the members can be reduced, successfully leading to cost reduction.

Although the present invention has been described herein with respect to a specific illustrative embodiment, the foregoing description is intended to illustrate, and not to restrict the scope of the invention. Those skilled in the art will realize that many modifications of the preferred embodiment could be made which would be operable. All such modifications, which are within the scope of the claims, are intended to be within the scope and spirit of the present invention.

What is claimed is:

1. A lever-support bracket apparatus for a small waterboat in which a seat is placed above a deck, an engine is placed below the deck, a jet propulsion unit is placed in the rear of the engine, a steering nozzle for fixing an ejection direction of jet water is placed in the rear of the jet propulsion unit, a reverse bucket for guiding the jet water to the front is placed in the rear of the steering nozzle, and the reverse bucket is made operable by an operation lever, wherein the operation lever is placed in the vicinity of a front end of the seat, and is attached to the deck by a lever-support bracket to swing freely, and wherein the lever-support bracket apparatus comprises a socket section into which a tongue-shaped piece at the front end of the seat can be inserted, said socket section integrally formed with said lever-support bracket to be a piece therewith.

2. A lever-support bracket apparatus for a small waterboat having a deck, and in which a seat is placed above the deck, an engine is placed below the deck, and a jet-propulsion unit is placed behind the engine, the waterboat also having a steering nozzle behind the jet propulsion unit for fixing an ejection direction of jet water, and a reverse bucket adjacent the steering nozzle for selectively guiding the jet water towards the front of the boat, the reverse bucket being operable by an operation lever, wherein said lever-support bracket apparatus is provided for placement in the vicinity of a front end of the seat, said apparatus comprising:

a lever-support bracket which is attachable to the deck of said waterboat and is pivotally attachable to said operation lever for facilitating control of the position of said reverse bucket, and a socket section for receiving a tongue-shaped piece at the front end of the seat;

wherein at least part of said socket section is rigidly connected to said lever-support bracket.

3. The lever-support bracket apparatus of claim 2, wherein the lever-support bracket comprises a base portion and an upper portion attached to the base portion and extending upwardly therefrom.

4. The lever-support bracket apparatus of claim 3, wherein the base portion comprises front and rear leg sections, each having left and right ends.

5. The lever-support bracket apparatus of claim 4, wherein each of the left and right ends of the front and rear leg sections has an attachment hole formed therethrough.

6. The lever-support bracket apparatus of claim 2, wherein the operation lever comprises disc having a hole formed therethrough to receive a mounting bolt.

7. The lever-support bracket apparatus of claim 2, wherein the operation lever has an arcuate slot formed therein to guide sliding movement thereof.

8. A small waterboat, comprising:

a deck;

a seat situated above the deck;

an engine situated below the deck;

a jet-propulsion unit located behind the engine;

a steering nozzle located behind the jet propulsion unit for fixing an ejection direction of jet water, and a reverse bucket adjacent the steering nozzle for selectively guiding the jet water towards the front of the boat, the reverse bucket being operable by an operation lever, wherein said lever-support bracket apparatus is provided for placement in the vicinity of a front end of the seat, said apparatus comprising:

a lever-support bracket which is attachable to the deck of said waterboat and is pivotally attachable to said operation lever for facilitating control of the position of said reverse bucket, and a socket section for receiving a tongue-shaped piece at the front end of the seat;

wherein at least part of said socket section is rigidly connected to said lever-support bracket.

9. The waterboat of claim 8, wherein the lever-support bracket comprises a base portion and an upper portion attached to and extending upwardly from the base portion.

10. The waterboat of claim 9, wherein the base portion of the lever-support bracket comprises front and rear leg sections, each having left and right ends.

11. The waterboat of claim 10, wherein each of the left and right ends of the front and rear sections of the base portion of the lever-support bracket has an attachment hole formed therethrough.

12. The waterboat of claim 8, wherein the operation lever comprises a disc having a hole formed centrally therethrough to receive a mounting bolt.

13. The waterboat of claim 8, wherein the operation lever has arcuate slot formed therein to guide sliding movement thereof.

14. The waterboat of claim 9, wherein the operation lever has an arcuate slot formed therein to guide sliding movement thereof.

15. The waterboat of claim 1, wherein at least a portion of the operation lever and the socket section are non-moveable relative to each other.

* * * * *